United States Patent [19]

Thomas

[11] 4,325,393

[45] Apr. 20, 1982

[54] HAIR STRAND SEPARATING IMPLEMENT

[76] Inventor: Louis N. Thomas, 990 NE. 156 Terrace, North Miami Beach, Fla. 33162

[21] Appl. No.: 180,693

[22] Filed: Aug. 25, 1980

[51] Int. Cl.[3] ..... A45D 24/00

[52] U.S. Cl. ..... 132/160; 132/160

[58] Field of Search ..... 132/143, 144, 145, 148, 132/151, 156, 160, 123

[56] References Cited

U.S. PATENT DOCUMENTS

| | | | |
|---|---|---|---|
| 1,643,168 | 9/1927 | Nevotti | 132/151 |
| 2,618,276 | 11/1952 | Hamperson et al. | 132/143 |
| 2,981,965 | 5/1961 | Kaye et al. | 132/151 |
| 3,275,007 | 9/1966 | Thackeray | 132/151 |
| 3,835,870 | 9/1974 | Sick | 132/160 |

*Primary Examiner*—Robert A. Hafer

*Attorney, Agent, or Firm*—Ernest H. Schmidt

[57] ABSTRACT

A hair styling implement to facilitate the withdrawal of spaced groups of hair strands from the scalp for separate treatment with bleach or the like for "frosting" or "streaking" has a plurality of equi-distantly spaced, arcuate hook members movable between open and closed positions with respect to the bottom surface of the body of the implement by an operating slide member at its top. After thus hookingly engaging spaced groups of hair strands for treatment, the implement is lifted from the scalp to isolate the strand groups thus selected for bleach or dye treatment.

7 Claims, 7 Drawing Figures

HAIR STRAND SEPARATING IMPLEMENT

BACKGROUND OF THE INVENTION

In the hair styling procedure commonly referred to as "frosting" or "streaking", spaced groups of hair strands are separated from the scalp hair and treated with bleach or dye solutions, or pastes, to present the desired color streaked or "frosted" effect. Various procedures have been devised for such hair treatment, all of which are tedious to perform and require substantial skill on the part of the operator, if satisfactory results are to be acheived. In the procedure usually used if substantial portions or the entire head of hair is to be streaked or frosted, an impervious cap is placed over the scalp and selected strand groups are pulled through openings in the cap with a hook-like implement inserted through small openings in the cap at the desired locations, after which they are separately treated with bleaching paste or the like at the outside of the cap.

In another procedure, the operator selects locks of hair from the scalp with the use of a comb, holds the hair thus lifted between the third and fourth finger of the opposite hand, and then weaves a "rats-tail", usually a projection at one end of the comb, in and out along the lock of hair so held to separate spaced strand portions to one side for treatment. This procedure is repeated sucessively at various locations on the scalp to achieve a desired overall effect in the finished coiffure. It will be readily apparent that this method of weaving a rat-tail or elongated pick at the end of the comb in and out of locks of hair to effect separation of hair strand groups for color treatment requires great dexterity on the part of the operator, and is particularly time consuming if substantial portions of the hair are to be treated.

It is, accordingly, the principal object of my invention to provide a novel and improved implement for separating spaced groups of hair strands from a head of hair for special treatment that obviates the deficiencies of procedures for this purpose heretofore devised.

A more particular object is to provide a hair strand separating implement having a plurality of simultaneously rotatable hook members movable between open and close positions in such a manner that when the implement is placed against the scalp and actuated to move the hook members between open and closed positions they will hookingly engage spaced groups of hair strands which can then be separated and isolated from the remaining head of hair for special treatment with bleach paste, dye, or the like to create the desired streaked or "frosted" effect in the finished coiffure.

Another object of the invention is to provide a novel hair strand separating implement of the character described that is so simple and effective in operation as to be well suited to self use by the consumer in hair "streaking" or "frosting".

Other objects, features and advantages of the invention will be apparent from the following description when read with reference to the accompanying drawings.

BRIEF DESCRIPTION OF THE DRAWINGS

In the drawings, wherein like reference numerals denote corresponding parts throughout the several views.

Figure 1:
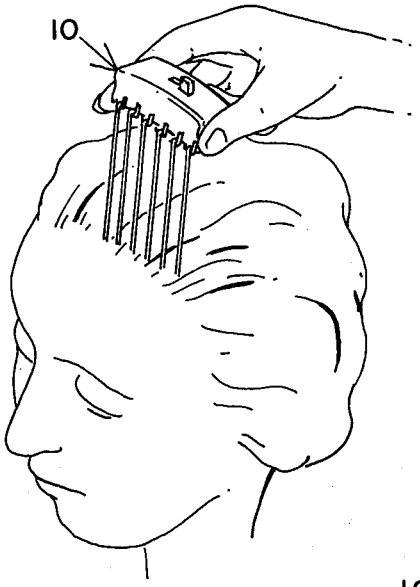
FIG. 1 is an oblique view, as seen from above, of a hair strand separating implement embodying the invention, illustrating its use in separating a plurality of spaced groups of strands from a lock of hair.

Referring first to FIGS. 2 through 7, reference numeral 10 designates, generally, a preferred form of hair strand separating implement embodying the invention, the same being comprised of a generally rectangular, somewhat elongated casing body 11 projecting outwardly at the top of which is an operating slide member 12, and extending outwardly along the side thereof, near the bottom, are a plurality of hook members 13. The hook members 13, in use, are movable in unison into hooking engagement with spaced groups of hair strands when applied to the scalp and controlled in the manner and for the purpose hereinafter more particularly described.

Figure 2:
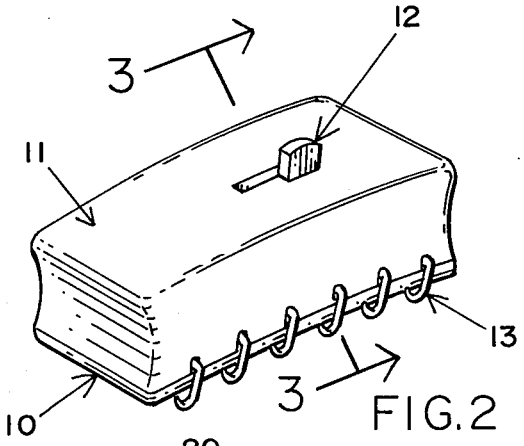
FIG. 2 is an oblique view of the hair strand separating implement, shown separately and in an enlarged scale.

The implement casing body 11, although of generally rectangular box-like shape, will preferably be of slightly curved or arcuate shape, as best illustrated in FIG. 2; and the end faces may be of slightly concave configuration from top to bottom to facilitate gripping between the thumb and forefinger upon use of the implement, as shown in FIG. 1. The casing body 11 will also preferably be molded of synthetic plastic material, and comprises a base-plate portion 14 and box-like cover portion 15, open at the bottom to define a peripheral edge 16 adapted to seat upon and inter-engage with a peripheral recess 17 formed along the top marginal edge portion of base-plate portion 14. Upon assembly a suitable cement will be used to secure the cover portion 15 with respect to the base-plate portion 14.

Figure 7:
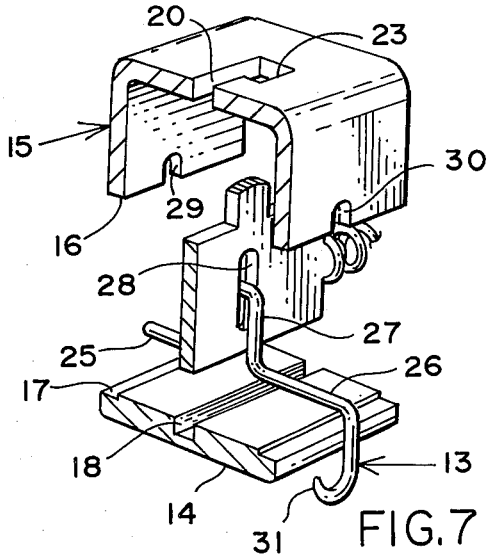
FIG. 7 is an oblique, "exploded" view of an intermediate, fragmentary section of the implement illustrating constructional and operational details.
Figure 6:
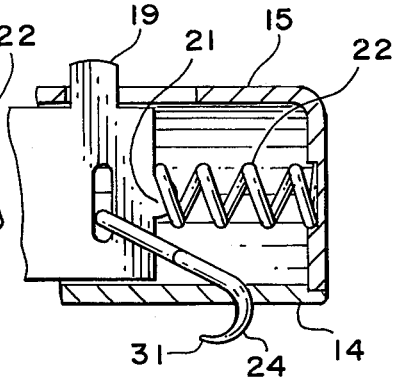
FIG. 6 is a cross-sectional view similar to that of FIG. 4 but showing the operating slide in the forward end position whereat the hook members are in fully open position.

The operating slide member 12, which may also be fabricated of a suitable plastic material, is of substantially flat, elongated shape so as to be slidingly engagable at its lower end along a central, longitudinal groove or track 18 formed in base-plate portion 14. An integrally formed tab 19 extending outwardly of the upper edge of operating slide member 12 projects through slot 20 provided in the upper surface of the cover portion 15. A central, rear edge portion of the operating slide member 12 is also formed with an arcuate projection 21 for the seating circumjacent therefore of a helical compression spring 22 constrained between the rear edge of said operating slide member and the inner, rear surface of cover portion 15 so as to yieldingly urge said slide member in the forward limit position determined by the abutment of operating slide tab 19 with the forward end of slot 20. In this position, the operating slide serves to hold the hook members 13 in their open position, as illustrated in FIG. 6, in the manner and for the purpose hereinafter more particularly described. As illustrated in FIGS. 2 and 7, the slot 20, at its rearward end, is provided with a sidewardly-offset elargement or recess 23 of such length as to accommodate the lateral slide fitting therein of operating slide member tab 19, for selectively locking said slide member 12 in withdrawn position against the reactive force of helical spring 22. In this position hook members 13 will be retained in their closed positions, i.e. with their arcuate hook portions 24 rotated in closed position against the underedge of the casing body 11 (see FIGS. 2 and 4) in the manner and for the purpose hereinafter more particularly described.

Figure 3:
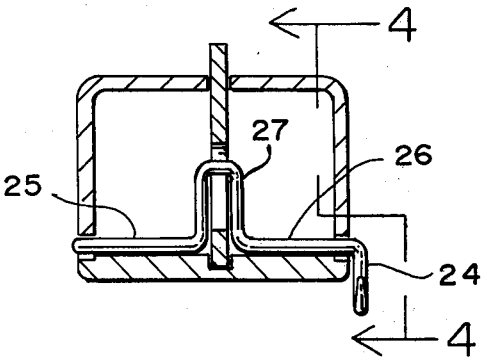
FIG. 3 is a transverse cross-sectional view taken along the plane indicated at 3—3 of FIG. 2 in the direction of the arrows.

As best illustrated in FIGS. 3 and 7, the hook members 13 are preferably formed by bending lengths of stiff wire, and are provided with a pair of opposed, co-axial arm portions 25 and 26 extending outwardly of a central, rectangular, U-shaped portion 27. The arm portion 26 is slightly longer than opposite arm portion 25, and terminates in an arcuate hook portion 24, said hook portion lying in a plane perpendicular with respect to the common axes of arm portions 25, 26 and extending in the opposite direction with respect to U-shaped central portion 27. As further illustrated in FIGS. 3 and 7, the operating slide member 12 is provided along its length with a plurality of equi-distantly spaced, vertical slots 28, one for each of the six hook members 13 (only one slot illustrated). The U-shaped central portions 27 of the hook members 13, upon assembly, are received, one each, within the operating slide member slots 28 for simultaneous cranking movement of said hook members, as is hereinafter described. As is further best illustrated in FIGS. 3 and 7, the cover portion 15 of the casing body 11 is provided along its bottom edges with opposed pairs of arcuate recesses 29, 30 (only one pair illustrated in FIG. 7) which serve to journal the outer ends of arm portions 25, 26 of hook members 13 with respect to said casing body.

Figure 4:
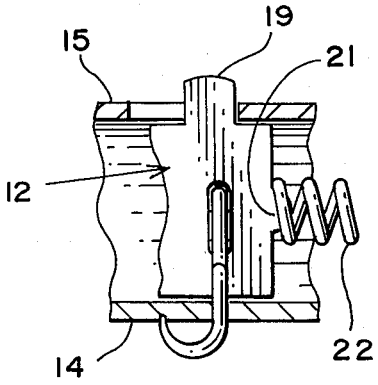
FIG. 4 is a fragmentary, longitudinal, cross-sectional view taken along the line 4—4 of FIG. 3 in the direction of the arrows and illustrating constructional details with the operating slide in the position corresponding with full closure of the hair strand separating hook members.
Figure 5:
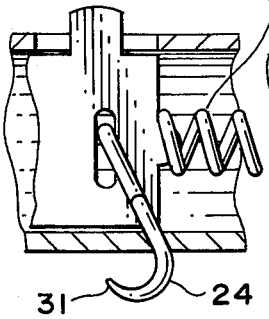
FIG. 5 is a cross-sectional view similar to that of FIG. 4, but showing the operating slide in the intermediate position whereat the hook members are in partially closed position.

As illustrated in FIGS. 4, 5 and 6, movement of the operating slide member 12 between its rearward-most position (FIG. 4) and its forward-most position (FIG. 6) by means of thumb tab 19, serves to crankingly rotate the hook members 13 between their respective closed and open positions. As further illustrated in FIG. 6, the tips 31 of the arcuate hook portions 24 are tapered so that, upon use of the implement as now to be described, they will rest flat against and close to the scalp to facilitate the grasping and separation of hair strands without discomfort or scratching.

In use, as illustrated in FIG. 1, the hair strand separating implement 10 will be placed against the scalp at that portion of the head where pluralities of groups of hair strands to be treated are to be separated from the rest of the head of hair, with the hook members 13 in their open positions, i.e. with the operating slide member 12 at its forward-most position as so retained by helical compression spring 22. Thereafter, the operating slide member tab 19 will be moved to the rearward-most position in slot 20 with the thumb or forefinger of the other hand, and locked in place temporarily by sideward movement of said tab into the retaining recess 23. As the operating slide member is thus moved, the hook members 13 will be rotated between the fully open positions of FIG. 6 to the fully closed positions of FIG. 4, so as to grasp spaced groups of hair strands for separate treatment. The implement will then be lifted from the scalp (see FIG. 1) to separate the groups of hair strands so selected, whereafter bleaching or other treatment will be accomplished in the usual fashion. After the spaced strand groups have been isolated for treatment, the operating slide member tab 19 will be pushed out of its retaining recess 23 so as to cause the hook members to open, after which the implement will be ready for use again in separating and isolating other groups of hair strands for treatment at another position of the scalp.

The principal advantage of the invention resides in the simplicity and rapidity with which evenly spaced groups of hair strands can be selected for frosting treatment or the like from locks of hair lifted from any portion of the scalp. A salient feature of the invention, moreover, resides in the time saving and uniformity of streaking achieved with use of the invention, which is particularly advantageous when substantial portions of a hair styling or coiffure are to be streak-bleached or streak-dyed.

While I have illustrated and described herein only one form in which my invention can be conveniently be embodied in practice, it is to be understood that this embodiment is presented by way of example only, and not in a limiting sense. The invention, in brief, comprises all the embodiments and modifications coming within the scope and spirit of the following claims.

What I claim as new and desire to secure by Letters Patent is:

1. A hair styling implement to facilitate the withdrawal of spaced groups of hair strands from the scalp for separate treatment, comprising, in combination, an elongated, substantially rectangular, hollow body member, a plurality of hook members journalled in spaced relation along one side of said body member, said hook members each being integrally formed with arcuate hook portions movable between withdrawn and outwardly-extended positions with respect to the underside of said body member upon the rotation of said hook members with respect to said body member, the outer end of said hook portions, when in their withdrawn positions, lying in a plane substantially coincident with the plane of said underside of said body member, and means for simultaneously rotating said hook members for moving said arcuate hook portions between said withdrawn and outwardly-extended positions.

2. A hair styling implement as defined in claim 1 wherein said hook members are integrally formed of bent wire, and wherein said hook member rotating means comprises an operating slide member supported for longitudinally sliding movement within said body member between forward-most and rearward-most positions with respect thereto, and crank means on said hook members extending through openings in said slide member for cooperative movements therebetween.

3. A hair styling implement as defined in claim 2 wherein said operating slide member comprises a manual actuation tab portion extending through a slot in the upper surface of said body member, the ends of said slot defining said forward-most and rearward-most positions of said operating slide member, said hook members each being integrally formed of bent wire and having a centrally located, U-shaped, laterally off-set, crank portion extending through respective vertical slots in said operating slide member within said body member.

4. A hair styling implement as defined in claim 3 including spring means normally constraining said operating slide member in its forward-most position, whereat said arcuate hook portions will be in their withdrawn positions.

5. A hair styling implement as defined in claim 4 wherein said spring means comprises a helical compression spring constrained between the rearward end of said operating slide member and the rear inner wall of said body member.

6. A hair styling implement as defined in claim 5 including means for releasably locking said operating slide member in its rearward-most position, whereat said arcuate hook portions will be in their outwardly-extended positions.

7. A hair styling implement as defined in claim 6 wherein the tips of said arcuate hook portions are roundly tapered and are so located and disposed with respect to said body member when in their outwardly-extended positions as to rest flat against and close to the scalp upon the underside of the body member being placed in abutting contact with the scalp.

* * * * *